US005415190A

United States Patent [19]

Ionescu

[11] Patent Number: 5,415,190

[45] Date of Patent: May 16, 1995

[54] CARBON MONOXIDE CLEANING APPARATUS

[76] Inventor: John Ionescu, 1000 Parkview Dr., #801, Hallandale, Fla. 33009

[21] Appl. No.: 205,936

[22] Filed: Mar. 2, 1994

[51] Int. Cl.[6] ..... B08B 3/02; B08B 9/00

[52] U.S. Cl. ..... 134/95.2; 134/95.3; 134/103.1; 134/111; 134/113; 134/169 R; 134/169 A

[58] Field of Search ..... 134/95.2, 95.3, 98.1, 134/99.1, 103.1, 103.2, 111, 113, 166 R, 166 C, 168 R, 168 C, 169 R, 169 A, 169 C; 15/302, 304

[56] References Cited

U.S. PATENT DOCUMENTS

| | | | |
|---|---|---|---|
| 1,298,973 | 4/1919 | Leahy | 134/98.1 X |
| 1,795,763 | 3/1931 | Cramer et al. | 134/99.1 X |
| 2,045,752 | 6/1936 | Butterworth | 134/168 R X |
| 2,240,227 | 4/1941 | Saussure | 134/168 R |
| 2,665,772 | 1/1954 | Greer et al. | 134/169 A X |
| 2,845,934 | 8/1958 | Payson | 134/99.1 X |
| 3,046,163 | 7/1962 | Kearney et al. | 134/168 R X |
| 3,120,237 | 2/1964 | Lang | 134/103.2 X |
| 3,121,027 | 2/1964 | Galanor | 134/168 R X |
| 3,775,053 | 11/1973 | Wisdom | 15/302 X |
| 3,916,924 | 11/1975 | McGowan | 134/95.3 |
| 3,951,185 | 4/1976 | Bower et al. | 134/169 R X |
| 4,348,162 | 9/1982 | Mancini | 134/98.1 X |
| 4,733,428 | 3/1988 | Malinge et al. | 15/302 |
| 5,065,703 | 11/1991 | Lee | 134/113 X |
| 5,259,406 | 11/1993 | Hoffmann | 134/95.2 X |
| 5,289,837 | 3/1994 | Betancourt | 134/113 X |

*Primary Examiner*—Philip R. Coe
*Attorney, Agent, or Firm*—Robert M. Downey

[57] ABSTRACT

A cleaning apparatus for cleaning the burning chambers of engines to remove carbon monoxide deposits and other accumulated residue therefrom. The apparatus includes a holding tank for containing a predetermined amount of cleaning solvent, a nozzle having a nozzle tip with a discharge outlet and a suction inlet, a supply line connecting between the holding tank and the outlet and a first pump for transferring solvent under pressure from the holding tank for discharge from the outlet into the burning chamber. A return line connects between the inlet of the nozzle and the holding tank and includes a second pump connected in-line for creating a suction at the inlet, causing solvent to be transferred back to the holding tank. An air supply line from a compressor connects to the solvent supply line via a three-way valve for selective discharge of pressurized air into the burning chamber to facilitate drying thereof after washing with the solvent.

9 Claims, 2 Drawing Sheets

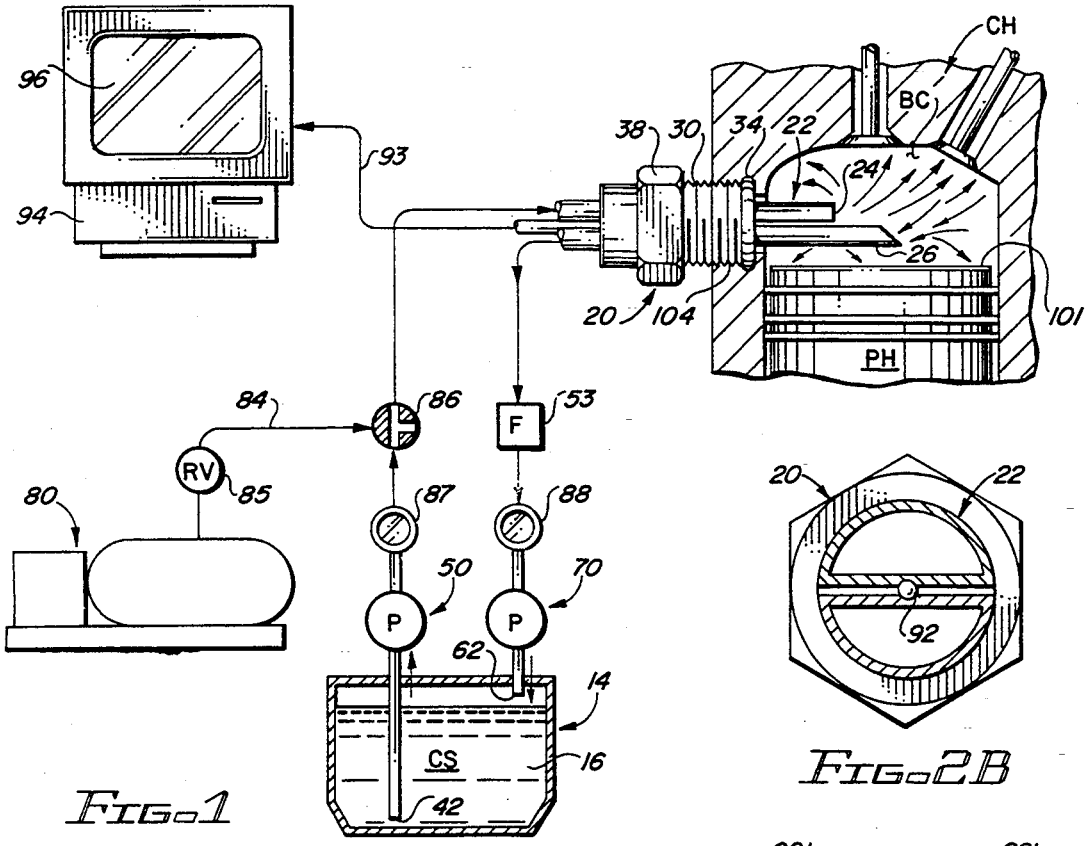
FIG. 1
FIG. 2B
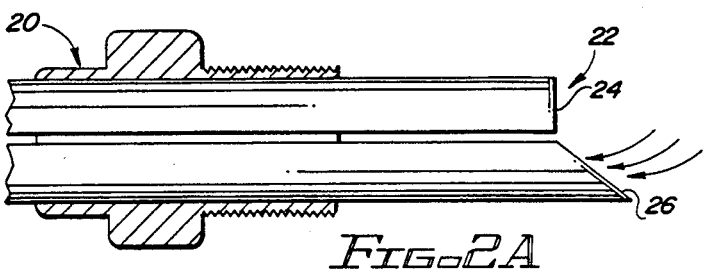
FIG. 2A
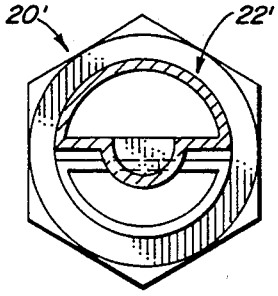
FIG. 3B
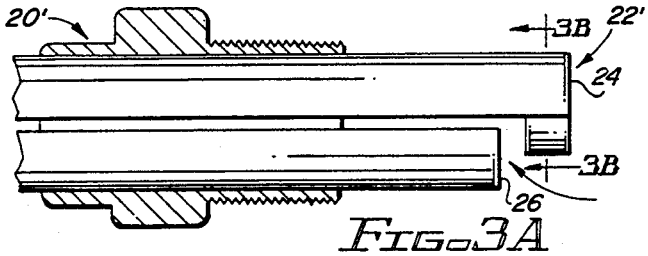
FIG. 3A
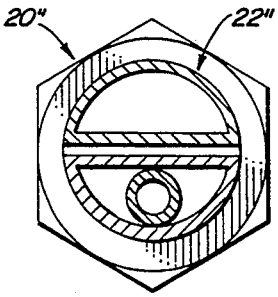
FIG. 4B
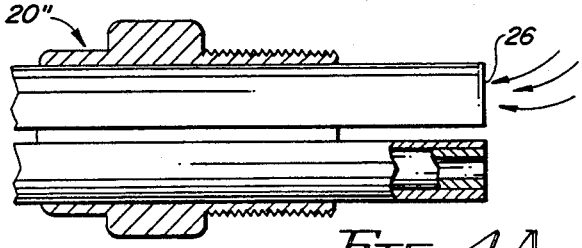
FIG. 4A

CARBON MONOXIDE CLEANING APPARATUS

BACKGROUND OF THE INVENTION

1. Field of the Invention

The present invention relates to a cleaning apparatus for cleaning an engine and more particularly a cleaning apparatus for cleaning of carbon monoxide deposits and other accumulated residue from within the burning chambers of an engine, wherein a cleaning solvent is pumped into and dispersed throughout the burning chamber and simultaneously sucked therefrom without opening or dismantling the engine.

2. Description of the Related Art

During the life of an engine, carbon monoxide deposits and residue build up around the walls and top of the pistons in the burning chambers as a result of the burning of fuel therein. As the amount of carbon monoxide residues accumulate in the burning chambers, fuel injected into the burning chamber is partially absorbed by the surrounding residue. As a result, the fuel consumption of the engine increases as well as the level of pollutant emissions. In order to maintain optimum performance levels of the engine and increase the engine life, it is necessary to periodically clean the burning chambers in order to remove carbon monoxide deposits. Presently, existing cleaning methods require partial dismantling of the engine, including removal of the cylinder head, in order to gain access to the burning chamber walls and piston heads. Obviously, this cleaning method is time consuming and quite costly. For this reason, cleaning of the burning chambers is rarely performed on a regular, periodic basis, but, rather, it is usually done at the time of making engine repairs.

Accordingly, there is a need in the present art for a cleaning apparatus specifically designed and adapted to quickly and efficiently clean and remove carbon monoxide deposits and other residue from the burning chamber of an engine without requiring dismantling or opening of the engine.

SUMMARY OF THE INVENTION

The present invention is directed to a cleaning apparatus for cleaning the burning chambers of an engine in order to remove carbon monoxide deposits and other accumulated residue therefrom, without having to open or otherwise dismantle the engine.

In accordance with the present invention, there is provided a holding tank for containing a predetermined quantity of cleaning solvent of the type commonly used to clean engine parts and the like. A nozzle includes a nozzle tip which is specifically structured for insertion within the burning chamber. The nozzle tip includes a discharge outlet structured and disposed for dispersing solvent throughout the burning chamber, and a suction inlet for drawing the solvent therethrough for return to the holding tank. A supply line connects between the solvent holding tank and the nozzle. A first pump is provided along the solvent supply line for transferring the solvent from the holding tank, under pressure, to the nozzle for discharge from the outlet of the nozzle tip. A solvent return line connects between the nozzle and the solvent holding tank and has a second pump connected therealong for creating a suction at the inlet of the nozzle tip, causing the solvent in the burning chamber to be drawn through the return line and returned to the holding tank.

An air supply line from a compressor feeds into the solvent supply line via a three-way valve which is specifically structured to facilitate selective flow of solvent during a washing cycle or, alternatively, pressurized air to the outlet of the nozzle tip during a drying cycle. In this manner, once the burning chamber has been completely rinsed with solvent, the three-way valve is actuated to close off the solvent supply from the holding tank and open the air supply line so that pressurized air is directed through the nozzle tip into the burning chamber for drying thereof. During the drying cycle, the second pump continues to operate providing a continuous suction at the inlet of the nozzle tip. Thus, the pressurized air being discharged into the burning chamber causes the solvent remaining therein to be circulated until it is eventually drawn through the inlet of the nozzle tip.

A filter is provided in-line along the solvent return line in order to remove particulate and other contaminates from the solvent prior to returning to the holding tank. Sight glasses may further be provided on both the solvent supply line and solvent return line to facilitate viewing of the flow of solvent therethrough. In this manner, proper flow through the supply and return lines can be verified. Additionally, visual identification of a change of color of the solvent in the return line assists the operator in determining completion of cleaning of the burning chamber.

Further, viewing means may be provided for viewing the surrounding inner surfaces of the inner chamber to verify complete removal of carbon monoxide deposits and other residue therefrom. In accordance with the present invention, the viewing means includes an optical sensor supported on the nozzle tip for positioning within the burning chamber. The optical sensor is interconnected to a computer processor and display monitor. Image data collected by the optical sensor is transmitted to the processor for visual display on the monitor. Accordingly, during the washing cycle and drying cycle, the operator can view the surrounding surfaces of the burning chamber to verify that all surfaces have been completely and thoroughly cleaned and dried.

Accordingly, with the foregoing in mind, it is a primary object of the present invention to provide a cleaning apparatus for cleaning the burning chambers of an engine in order to remove carbon monoxide deposits and other residue therefrom without having to open or otherwise dismantle the engine.

It is another object of the present invention to provide a cleaning apparatus for cleaning carbon monoxide deposits from within the burning chambers of an engine in a rapid and efficient manner, requiring less than 2 minutes time in order to clean each burning chamber.

It is a further object of the present invention to provide a cleaning apparatus, as described above, which will significantly reduce the level of pollutant emissions of the engine.

It is still a further object of the present invention to provide a cleaning apparatus, as described above, which will increase the fuel economy of an engine by as much as 30%.

It is yet another object of the present invention to provide a cleaning apparatus, as described above, which will significantly increase the life of an engine, while maintaining optimal performance levels.

It is yet another object of the present invention to provide a cleaning apparatus for cleaning the burning chambers of an engine which is specifically designed to recirculate a predetermined quantity of cleaning solvent for reuse throughout washing operations.

It is still a further object of the present invention to provide an engine cleaning apparatus which is designed for cleaning of all types of automobile and jet airplane engines having internal burning chambers including, but not limited to, all gas and diesel engines for automobiles, boats and airplanes, jet and helicopter engines, and ship engines which activate electrical generators.

These and other objects and advantages of the present invention will be more readily apparent in the description which follows.

BRIEF DESCRIPTION OF THE DRAWINGS

For a fuller understanding of the nature of the present invention, reference should be had to the following detailed description taken in connection with the accompanying drawings in which:

FIG. 1 is a schematic illustration, shown in partial cross-section, illustrating the primary structural components of the present invention and the manner of operation thereof;

FIG. 2A is a side elevation, in partial section, illustrating a first preferred embodiment of a nozzle of the present invention;

FIG. 2B is a top plan view of the nozzle tip of FIG. 2A;

FIG. 3A is a side plan view, in partial section illustrating a second preferred embodiment of a nozzle of the present invention;

FIG. 3B is a top plan view of a nozzle tip of the nozzle of FIG. 3A;

FIG. 4A is a side plan view, in partial section, illustrating a third preferred embodiment of a nozzle of the present invention;

FIG. 4B is a top plan view of a nozzle tip of the nozzle shown in FIG. 4A;

Like reference numerals refer to like parts throughout the several views of the drawings.

DETAILED DESCRIPTION OF THE PREFERRED EMBODIMENT

Figure 5:
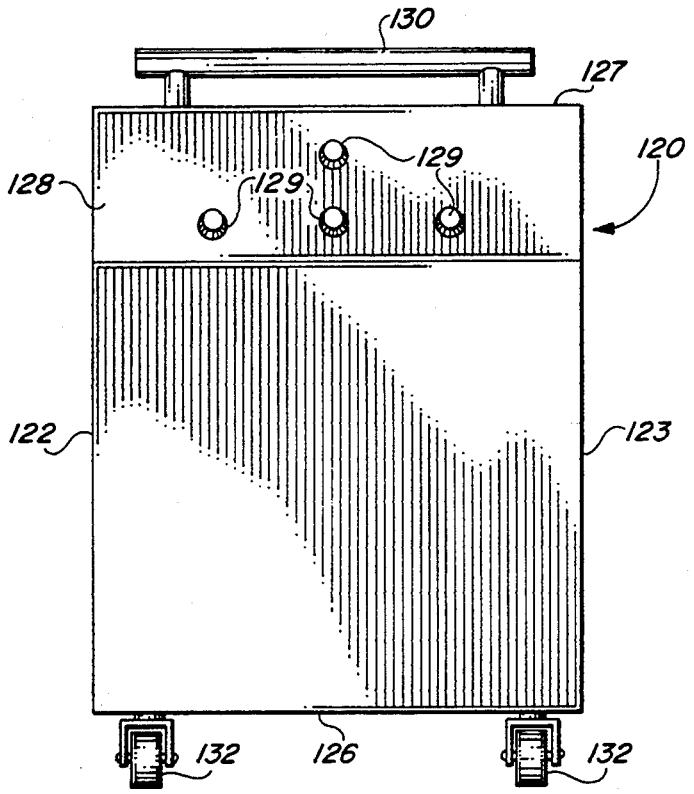
FIG. 5 is a front elevation of a housing for continuing some of the components of the apparatus therein.

Referring initially to FIG. 1, there is generally illustrated the cleaning apparatus 10 of the present invention. The cleaning apparatus 10 includes a solvent holding tank 14 structured and configured to contain a predetermined quantity of cleaning solvent CS therein, and thus defining a reservoir 16 of cleaning solvent.

A nozzle 20 includes a nozzle tip 22 specifically structured for insertion within the burning chamber BC of an engine. The nozzle tip 22 includes a discharge outlet 24 structured to discharge and disperse cleaning solvent throughout the burning chamber BC as indicated by the arrows in FIG. 1, so that the solvent hits all surrounding surfaces in the burning chamber, including the top surface 101 of the piston head PH. The nozzle tip 22 further includes a suction inlet 26 structured and disposed to draw the solvent in the burning chamber therethrough. The nozzle 20 is provided with a threaded collar 30 specifically structured for threaded engagement with a threaded surface of the spark plug port 104 extending through the cylinder head CH and into the burning chamber BC. An O-ring seal 34 is on the collar 30 creates a seal against a shoulder in the spark plug port 104 so that the solvent being dispersed under pressure within the burning chamber BC does not leak through the spark plug port. A multi-sided collar 38 is further provided on the nozzle 20, resembling a hex nut, to facilitate threaded advancement or withdrawal of the threaded collar 30 of the nozzle 20 within the spark plug port, using a wrench or other like tool.

A solvent supply line 40 includes a first end 42 located within the solvent reservoir 16 of holding tank 14. The solvent supply line 40 leads to, and connects with, the nozzle 20 in fluid connection with the outlet 24 thereof. A first pump 50 is connected in-line along the solvent supply line 40 and is specifically structured to transfer from the solvent from the holding tank 14 and through the supply line 40 for discharge out from the outlet 24 of the nozzle tip 22. Thus, operation of pump 50 serves to deliver a continuous pressurized flow of solvent to the nozzle for discharge in a dispersed array throughout the burning chamber, causing the solvent to strike all surfaces with sufficient pressure to remove accumulated carbon monoxide deposits and other residue therefrom.

A solvent return line 60 extends from the nozzle 20 to the holding tank 14, terminating at a distal end 62 within the holding tank 14. The return line 60 is connected in fluid communication with the suction inlet 26 of the nozzle tip 22. A second pump 70 is provided in-line along the solvent return line 60 and is specifically structured and disposed to generate a suction force at the suction inlet 26, such that solvent dispersed throughout the burning chamber BC is drawn through the inlet 26, and subsequently through the solvent return line 60 transfer back into the holding tank 14. Both the supply line 40 and return line 60 may be a hose or other conduit having a gauge and diameter sufficient to handle a pressurized liquid flow of at least 40 pounds.

An air compressor 80 and attached air supply hose 84 connect to the solvent supply line 40, along a length thereof via a three-way valve 86. The air supply hose 84 is fitted with a relief valve 85 structured to release air from within the hose once reaching a predetermined pressure in order to avoid bursting the air hose 84. The three-way valve 86 is specifically structured and configured to selectively close off either the solvent supply line 40 leading from the holding tank 14 to the valve 86, permitting air flow from the compressor 80 to continue through the supply line 40 to the nozzle 20. Alternatively, the three-way valve 86 may be selectively actuated to close off the air supply from the compressor 80, while permitting the solvent to flow from the holding tank 14 through the supply line 40 to the nozzle 20.

During operation of the cleaning apparatus 10 in a wash cycle, the first pump 50 and second pump 70 would be actuated, once the nozzle 20 is fitted within the burning chamber BC, so that continuous pressurized flow of solvent CS is pumped from the holding tank 14 for dispersal throughout the burning chamber and, simultaneously drawn through the inlet 26 for return back into the holding tank 14. Once having determined thorough cleaning of the burning chamber, the wash cycle is discontinued by turning off the first pump 50 as the second pump 70 on the return line continues to draw solvent from within the burning chamber through the nozzle 20 for return to the holding tank 14. At this point, a drying cycle is initiated by actuating the three-way valve 86 to close off the solvent supply from the holding tank 14 and open the air supply from the compressor 80, whereupon a pressurized flow of air is discharged from the outlet 24 of the nozzle tip 22, causing the remaining solvent within the burning chamber BC to be circulated, increasing the efficiency of the solvent pickup at the suction intake 26. The drying cycle continues until the burning chamber is substantially dried of solvent, at which point, both the second pump 50 and compressor 80 are turned off. The nozzle 20 is then removed from the spark plug port and refitted to a next spark plug port of another burning chamber in accordance with the firing order of each piston of the engine. Prior to fitting to the next burning chamber, the cam shaft of the engine must be rotated in order to move the piston in the next succeeding burning chamber to the fully raised position, as occurs during combustion of fuel within the burning chamber according to the firing order.

A filter 53 is provided in-line along the solvent return line 50 for removing carbon monoxide deposits, particulate and other contaminates from the solvent being returned to the holding tank 14.

The solvent supply line 40 and solvent return line 50 may be provided with sight glasses 87, 88 to facilitate viewing of solvent flow therethrough. During the wash cycle, completion of cleaning of the burning chamber may be determined by viewing a change in color of the solvent through the sight glass 88 on the return line 50. Once the carbon monoxide deposits and other residue have been completely washed from within the burning chamber, a noticeable color change of the solvent from a dark color to a substantially lighter color can be viewed through the sight glass 88, thus indicating to the operator completion of the wash cycle, at which point the drying cycle may be commenced.

In order to further view the status of cleaning during the washing cycle, viewing means for viewing the inside surrounding surfaces of the burning chamber may be provided. In accordance with a preferred embodiment of the present invention, an optical sensor is supported on the nozzle tip 22, preferably between the inlet 24 and outlet 26 (see FIG. 2B). The optical sensor 92 is specifically structured to view the surrounding surfaces of the burning chamber and collect image data which is transmitted through a linkage 93 connecting to a computer processor 94. The image data is processed in the computer processor 94 and thereafter displayed on a monitor 96. The images displayed on the monitor 96 illustrate to the operator the surrounding surfaces within the burning chamber, enabling the operator to determine whether all carbon monoxide deposits and residues have been removed therefrom.

Referring to FIGS. 2A–4B, there is illustrated various nozzles 20, 20' and 20'' in accordance with preferred embodiments of the present invention. The nozzle 20 shown in FIGS. 2A and 2B is shown to include the optical sensor 92. It is noted that while the other nozzles 20', 20'' do not show the optical sensor 92, they may be provided with the optical sensor 92 if desired. The nozzle 20 shown in FIGS. 2A and 2B includes a nozzle tip 22 which is ideally suited for use on engines having one cam shaft. The nozzle 20' shown in FIGS. 3A and 3B is more particularly suited for engines having two cam shafts. Referring to FIGS. 2A–3B, it can be seen that the nozzle tip 22 of the nozzle 20 is substantially different in configuration than the nozzle tip 22' of the nozzle 20' shown in FIGS. 3A, 3B. Specifically, the configuration and arrangement of the outlets 24 and inlets 26 of the respective nozzle tips 22, 22' is substantially different in order to accommodate for a difference in configuration of the burning chambers of the respective engine types.

The nozzle 20'' shown in FIGS. 4A and 4B includes a steam ejector outlet 27 in addition to the outlet 24 and suction inlet 26. This particular 20'' can be further connected with a steam supply source enabling steam to be injected into the burning chamber in order to facilitate loosening and removal of stubborn deposits and residue which is otherwise difficult to remove with solvent.

Figure 6:
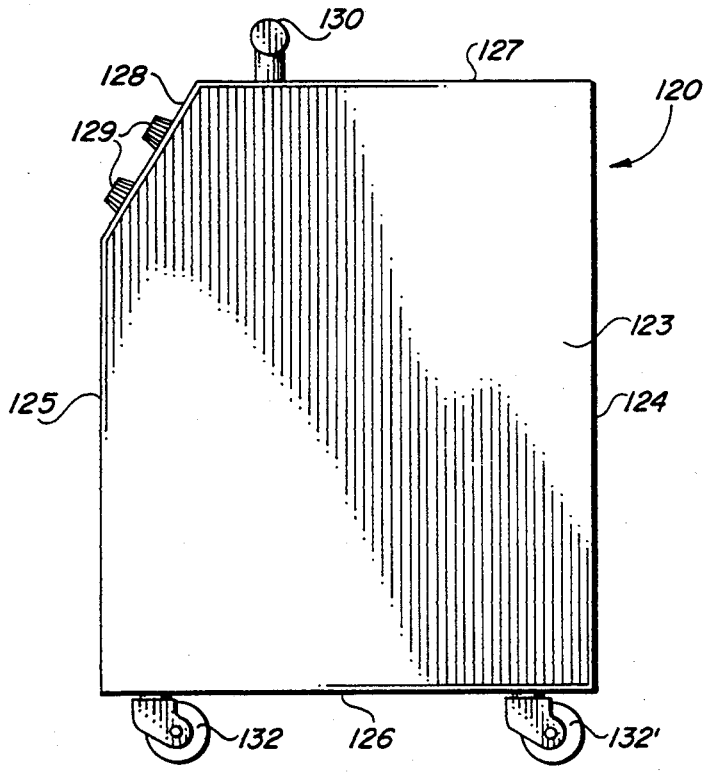
FIG. 6 is a side elevation of the housing of FIG. 5.

Referring to FIGS. 5 and 6, a housing 120 may be provided for accommodating various components of the apparatus 10 including the solvent holding tank 14, the pumps 50, 70, the air compressor 80 and filter 53. As seen in FIGS. 5 and 6, the housing 120 is designed for portability and includes opposite side walls 122, 123, a rear wall 124, a front wall 125, a bottom 126 and top 127. The front wall 125 is further provided with a control panel 128 including a plurality of controls 129 for activating the pumps 50 and 70 and the compressor 80. A handle 130 and front and rear wheels 132, 132' facilitate transport of the housing 120 along a floor surface. The solvent supply line 40 and return line 60 extend through one of the walls of the housing (not shown in the drawings) to the nozzle 20. In this manner, the housing defines a cart which can be conveniently moved around the automobile as needed during cleaning of the burning chambers.

Now that the invention has been described,

What is claimed is:

1. A cleaning apparatus for cleaning burning chambers of an engine comprising:

a holding tank for containing a predetermined quantity of a liquid cleaning solvent therein and defining a solvent reservoir, a nozzle structured for individual insertion within each of the burning chambers and including a nozzle tip having an outlet for discharging a flow of solvent under pressure in a sprayed array throughout the burning chamber, and a suction inlet for intake of the solvent from within the burning chamber, a supply conduit connecting to said holding tank and said nozzle to facilitate transfer of the solvent from said solvent reservoir to said outlet of said nozzle tip, first pump means interconnected to said supply conduit for transferring a continuous flow of solvent under pressure from said solvent reservoir to said outlet of said nozzle tip for discharge therefrom, a return conduit connecting to said nozzle and said holding tank to facilitate transfer of the solvent through said inlet of said nozzle tip from within the burning chamber to said solvent reservoir, second pump means interconnected to said return conduit for transferring the solvent from within said burning chamber to said solvent reservoir, and an air compressor and air supply hose structured to selectively deliver a flow of pressurized air, at a predetermined pressure into said burning chamber.

2. A cleaning apparatus as set forth in claim 1 including multi-directional valve means interconnected to said supply conduit and said air supply hose and being structured and disposed for selectively controlling the flow of solvent and pressurized air to said outlet of said nozzle tip for discharge into said burning chamber.

3. A cleaning apparatus as set forth in claim 2 wherein said multi-directional valve means includes a three-way valve structured to selectively permit flow of solvent to said nozzle tip while simultaneously preventing flow of air from said compressor to said nozzle tip and, alternatively, to selectively permit flow of air from said compressor to said nozzle tip while simultaneously preventing flow of solvent thereto.

4. A cleaning apparatus as set forth in claim 1 including viewing means for viewing surrounding surfaces of the burning chamber and including an optical sensor supported on said nozzle tip and interconnected to a computer processor and display means, said optical sensor being structured and disposed to collect and transmit image data to said processor for visual display on said display means.

5. A cleaning apparatus as set forth in claim 1 wherein said supply conduit and said return conduit each include a sight glass connected in-line therewith to permit viewing of the solvent flowing therethrough.

6. A cleaning apparatus as set forth in claim 1 wherein said return conduit includes an in-line filter between said nozzle and said solvent reservoir, said filter being structured and disposed to remove contaminates such as carbon monoxide deposits from the solvent flowing through said return conduit.

7. A cleaning apparatus as set forth in claim 1 further including steam injection means on said nozzle for injecting a pressurized flow of steam into said burning chamber.

8. A cleaning apparatus as set forth in claim 7 wherein said nozzle includes a steam injection outlet structured for fluid interconnection with a steam supply source, said steam injection outlet being structured and disposed to direct the flow of steam throughout the burning chamber and onto surrounding surfaces thereof.

9. A cleaning apparatus as set forth in claim 1 wherein said nozzle further includes thread means thereon for threaded, mating engagement with a threaded surface of a spark plug port in a cylinder head of the engine.

* * * * *